United States Patent [19]

de Wit

[11] 3,996,988

[45] Dec. 14, 1976

[54] VENETIAN BLIND, PREFERABLY A VERTICAL BLIND

[75] Inventor: Hendrik de Wit, Rotterdam, Netherlands

[73] Assignee: Hunter Douglas Industries B.V., Rotterdam, Netherlands

[22] Filed: Jan. 16, 1976

[21] Appl. No.: 649,723

[30] Foreign Application Priority Data

Jan. 23, 1975 Netherlands ..... 7500815

[52] U.S. Cl. ..... 160/168 R; 160/176 R

[51] Int. Cl.[2] ..... E06B 9/26; E06B 9/36

[58] Field of Search ..... 160/166 A, 168, 172, 160/173, 176; 64/30 E, 30 D

[56] References Cited

UNITED STATES PATENTS

| | | | |
|---|---|---|---|
| 2,199,999 | 5/1940 | Jensen et al. | 64/30 E |
| 3,054,446 | 9/1962 | Cayton | 160/173 |
| 3,455,364 | 7/1969 | Fukuoka | 160/176 |
| 3,802,222 | 4/1974 | Weber | 64/30 E |
| 3,860,056 | 1/1975 | Bruneau | 160/176 |

*Primary Examiner*—Peter M. Caun
*Attorney, Agent, or Firm*—Stevens, Davis, Miller & Mosher

[57] ABSTRACT

A vertical venetian blind including a driving shaft, a plurality of slat travellers each having a driven shaft and a slip coupling for connecting the driving shaft to the driven shaft, and a plurality of slats each connected to a driven shaft. The slip coupling includes a bushing mounted on the driving shaft to rotate with and to slide along the driving shaft, and a worm tightly enclosing the bushing and having a screw thread. The driven shaft includes a worm wheel and two stop cams for contacting ends of the screw thread. The worm can slip with respect to the bushing when the driving shaft rotates and one end of the screw thread contacts one of the cams or the other end of the screw thread contacts the other stop cam.

10 Claims, 5 Drawing Figures

VENETIAN BLIND, PREFERABLY A VERTICAL BLIND

The present invention relates to a venetian blind, preferably a vertical blind, having a driving mechanism including a driving shaft and a driven shaft, forming an angle between the shafts, gear transmission means, and a slip-coupling arranged between both shafts.

With existing venetian blinds of this type the slip-coupling usually contains parts provided with friction surfaces pressed together, e.g., by a spring. The design of such a construction is rather complicated and takes up much room.

The present invention has as an object to provide a venetian blind of the above-mentioned type with a slip-coupling which can be manufactured and mounted easily and cheaply. The slip coupling requires very little room so that the size of the surrounding structure also can be reduced.

According to the present invention, this object may be achieved because the slip-coupling is formed of a boss-shaped surface on the driving shaft, this surface being tightly enclosed by a bush-shaped gear. The mutual clamping surface between the boss-shaped surface and the bush-shaped gear is reduced because the boss-shaped surface or the interior of a bore in the bush-shaped gear is provided with at least one thickening or raised part. The bush-shaped gear engages a second gear, immovably fixed onto the other shaft and provided with at least one stop, functioning in conjunction with the face of the tooth on the bush-shaped gear. The bush-shaped gear can slip with respect to the boss-shaped surface in case the face of the tooth on the bush-shaped gear touches the stop of the second gear.

According to another characteristic of the present invention, the boss-shaped surface is formed by a bushing fitted onto the driving shaft. The bushing cannot rotate with respect to this shaft and is provided with three thickenings or raised parts spaced apart along the circumference of the bushing at equal distances, whereas the second gear, which is provided with a stop cam, is positioned on the driven shaft.

Another characteristic of the present invention is that the second gear is provided with a pair of stop cams in two places along its circumference.

According to a still further characteristic of the present invention, the bush-shaped gear is a worm having a screw thread and the second gear is a straight gear, whereby a stop cam is situated in a tooth space between two adjacent teeth of the straight gear.

The driving mechanism provided with a special slip-coupling according to the present invention, can be applied successfully to a so-called vertical blind, of the type whereby the construction is mainly housed in a so called slat traveller. The venetian blind includes a number of slat travellers which are slidably mounted in a head rail, each traveller having a slat which is vertically arranged. With this application, apart from the faster and easier assembly due to the small size of the slip-coupling according to the invention, the slat travellers and the head rail also can have small dimensions, which results in considerable cost savings and improved visual appearance. Since each vertical blind has a considerable number of slat travellers, namely one or two for each slat, the advantages are obvious.

The drawings illustrate a slip-coupling of the present invention as applied to one of the usual types of vertical blinds as described above. However, the invention is not limited to this type and application, but embodies all the variations falling within the scope of the claims.

Figure 1:
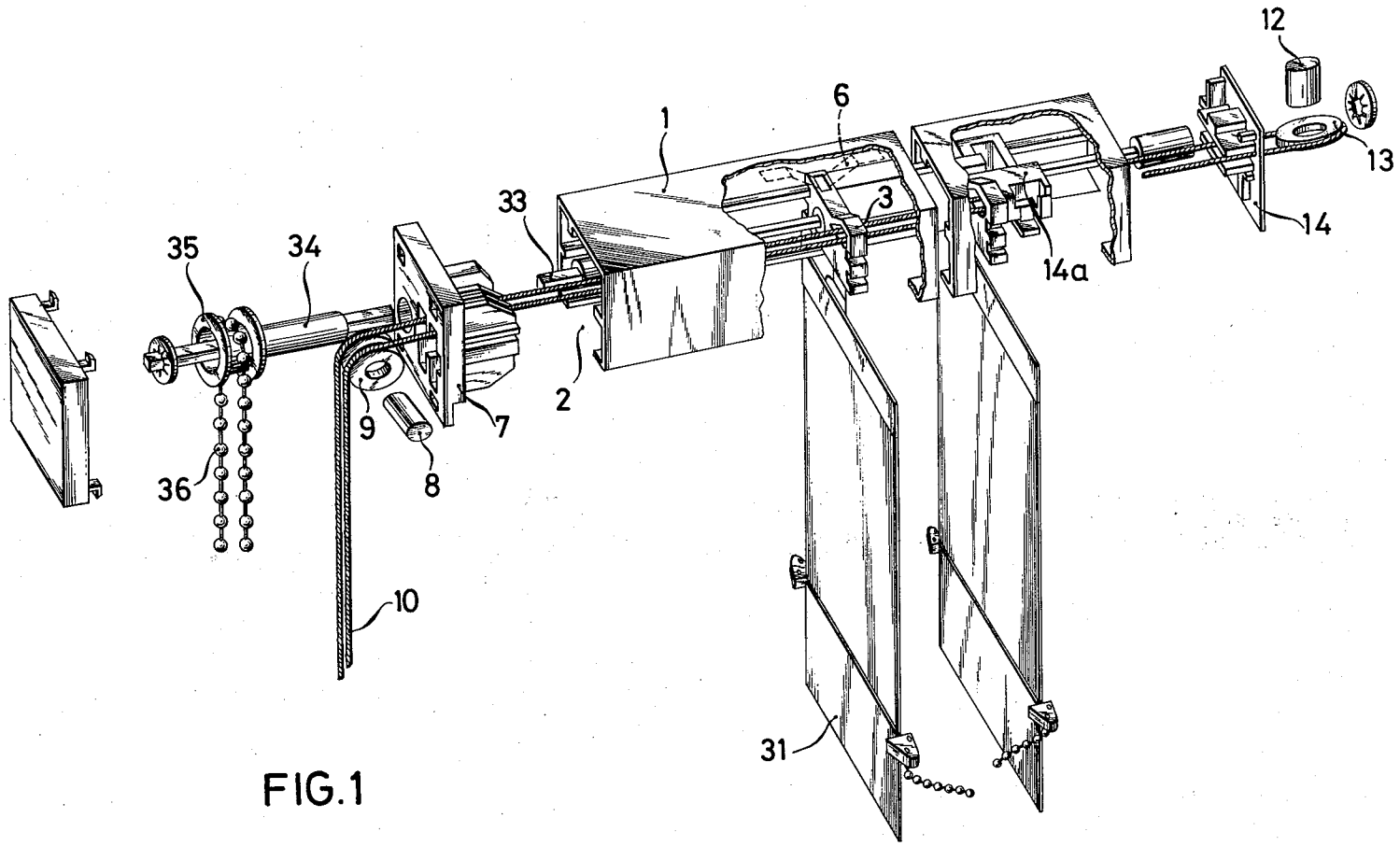
FIG. 1 shows in perspective a part of a vertical blind, whereby several parts are reproduced at a certain distance from each other and some parts are omitted to show more clearly the hindmost parts.

The vertical blind reproduced in FIG. 1 comprises a head rail 1, the bottom surface of which is slotted 2 over its full length. A number of slat travellers 3 are mounted in the head rail 1 and can slide freely in the interior of the rail. For this purpose two open slots 4 are made in the sides of the slat travellers 3. These slots fit onto ribs 5 available on the sides of the head rail. The slat travellers are coupled to each other with the aid of spacers 6 and in such a way that they can be slid together in order to form a package, while each slat traveller can only be displaced over a limited distance from its adjacent slat traveller.

In one end of the head rail 1 a cord pulley holder 7 is incorporated, in which two cord pulleys 9, revolving around a horizontal pulley shaft 8, are situated.

Parallel running parts of a cord 10 are led across both cord pulleys 9. This cord passes through openings in the slat travellers 3 and is led towards the end of the head rail opposite the cord pulley holder 7 and around a pulley 13 rotating on a vertical pulley shaft 12. The shaft 12 is situated in a return pulley holder 14 fixed at the end of the head rail 1 opposite the cord pulley holder 7.

Furthermore, the cord is fixed to a pull cord traveller **14*a* which in turn is fixed to the slat traveller nearest the return pulley holder 14, so that when either end of the cord 10 is pulled, all the slat travellers move to one end of the head rail 1**, or are arranged over the full length of the head rail at a certain distance from each other.

Figure 5:
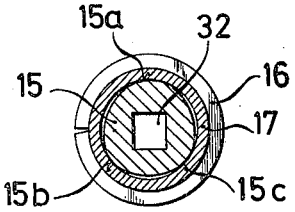
FIG. 5 shows a cross-section through the actual slip-coupling.

In each slat traveller a bushing 15 is fitted around a horizontal rotatable shaft running parallel to the length of the head rail 1. As shown in FIG. 5, the oval boss-shaped surface of the bushing 15 is enclosed tightly by a worm 17 having one screw thread 16. In the example given, the ellipticity of the boss-shaped surface of the bushing 15 is obtained by providing this boss-shaped surface with three thickenings or raised parts **15*a*, *b*, *c* situated apart along the circumference of the bushing 15 at equal distances. Consequently, the mutual clamping surface between the bushing 15 and the bore in the worm 17 is reduced. Clamping is such that when the bushing 15 rotates the worm 17 turns together with the bushing 15 without slipping, until, for reasons explained below, further rotation of the worm 17 is prevented, after which the bushing 15** may continue to rotate and will slip in the interior of the worm without excessive wear.

The worm 17 engages the teeth 19 of a worm wheel 20 consisting of a bushing 21 closed at one end, on the circumference of which teeth 19 are provided.

Figure 2:
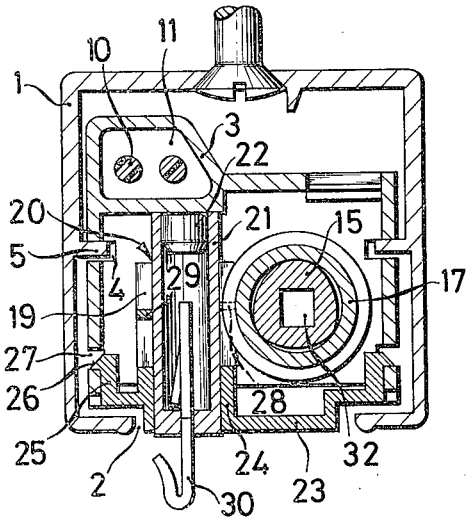
FIG. 2 shows a cross-section through the head rail shown in FIG. 1 as well as a slat traveller situated in this head rail.
Figure 3:
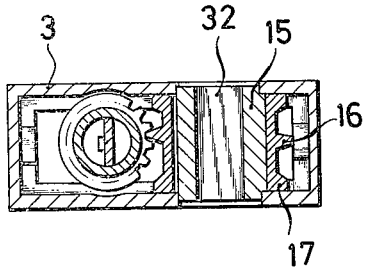
FIG. 3 shows a cross-section through the slat traveller reproduced in FIG. 2.
Figure 4:
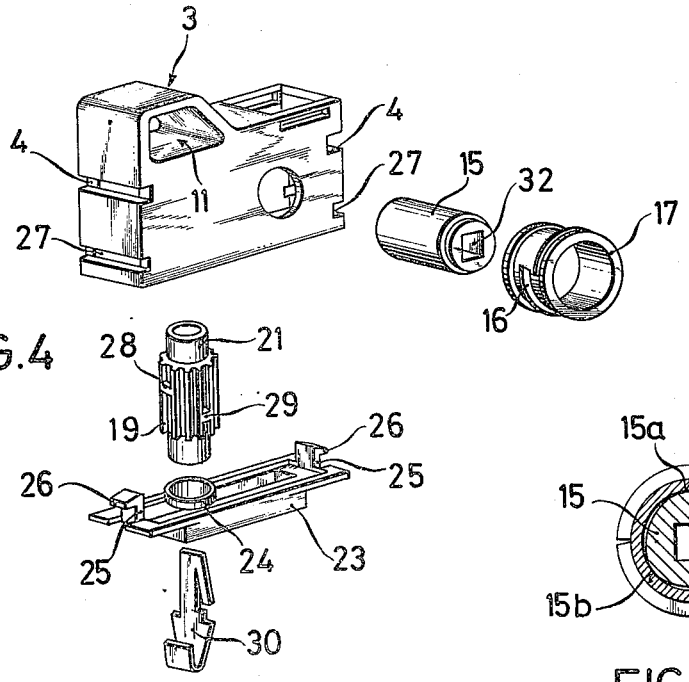
FIG. 4 shows in perspective a slat traveller and the parts contained therein, reproduced at a certain distance apart.

The top of the worm wheel 20 is rotatably supported by a journal 22 forming a hole with the slat traveller. The lower side of the bushing 21 is supported in a bearing hole 24 provided in a cover 23. The cover 23 closes the lower side of the slat traveller and is retained therein by means of elastic extending portions on the cover provided with notches 26 engaging the recesses 27 provided in the sides of the slat traveller. As appears from FIGS. 2 and 4, stop cams 28, 29 are provided between two teeth of the worm wheel 20, whereby the stop cam 28 is positioned slightly higher than the stop cam 29.

The closed end of the bushing 21 is provided with a slot to accommodate a hook 30 protruding from underneath the bushing. The hook 30 attaches a slat 31 to a slat traveller 3.

The oval bushings 15 are provided with continuous holes 32 having a square section. A driving shaft 33 having a square section extends through the various bushings 15 of the slat travellers mounted in the headrail 1. The bushings 15 may be slid along the driving shaft 33, but cannot rotate around this shaft. At the end of the driving shaft 33 a bushing 34 is mounted on which a ball chain pulley 35 is fitted. A ball chain 36 passes across the ball chain pulley 35, with the aid of which the bushing 34 as well as the driving shaft 33 may revolve.

When the driving shaft 33 is rotated the bushing 15 on the shaft 33 in the various slat travellers will revolve as well until one end of the screw thread 16 touches a stop cam 28 or 29. If one continues to turn the shaft 33 the worm 17 will not be able to turn any further and then every bushing 15 will slip with respect to the matching worm 17. Consequently, turning of the shaft 33 may be continued without running the risk of damaging the various accessories in the slat traveller.

When the shaft 33 is turned in the opposite direction the worm 17 is taken along instantly by the bushing 15, until the other end of the screw thread 16 touches the other stop cam 28 or 29, at which moment a renewed slipping of the bushing 15 will occur with respect to the worm 17 because a further turning of the worm 17 is prevented. With the above-mentioned venetian blind the various parts are dimensioned in a special way and in particular the place of the stop cams 28 and 29 between the threads 19 of the worm wheel are chosen in such a way that each slat, from a position at square angles to the surface to be shut off, may be turned approximately at an angle of 80° in both directions. In the last-named positions the slats cover the surface to be shut-off completely if the slat travellers are arranged over the full length of the headrail and at equal distances apart.

It is additionally pointed out that the slat travellers as well as the parts contained therein may be manufactured preferably of plastic.

Although with the above-mentioned example a worm is used provided with a single screw thread and a matching straight-toothed worm wheel, it will be clear that differently shaped gears may be applied, e.g., in the form of worm wheels with more threads or other toothed gearings, such as bevel- or skew gearings.

I claim:

1. A venetian blind, comprising a. a movable driving shaft;

b. a movable driven shaft extending at an angle with respect to said driving shaft;

c. a slip coupling for connecting said driving shaft to said driven shaft; said slip coupling including means on said driving shaft having a boss shaped surface, and a first bush shaped gear tightly enclosing said boss shaped surface means and having a tooth means, one of said first gear and said surface means having a raised part by which said first gear contacts said surface means to tightly enclose said surface means; and d. a second gear on the driven shaft and engaged by said tooth means of said first gear, said second gear having a first stop for stopping movement of said first gear, wherein said first gear may slip with respect to said surface means when said driving shaft moves and a part of said tooth means of said first gear comes in contact with said stop of said second gear.

2. A venetian blind according to claim 1 wherein said driving shaft is rotatable and said surface means comprises a bushing mounted on and rotatable with said driving shaft, said bushing having three raised parts about the circumference of said bushing at equal distances apart.

3. A venetian blind according to claim 1 wherein said second gear comprises a second stop for stopping movement of said first gear when the other end of said tooth means comes in contact with said second stop, said first and second stops being spaced apart along the circumference of said second gear.

4. A venetian blind according to claim 1 wherein said first gear comprises a worm having a screw thread and said second gear comprises a straight toothed worm wheel, said first stop comprising a stop cam being provided in a space between two adjacent teeth of said worm wheel.

5. A venetian blind according to claim 1 wherein said blind is a vertical blind.

6. A driving mechanism according to claim 1 wherein said surface means has said raised part.

7. A driving mechanism according to claim 1 wherein the inner periphery of said bush shaped gear has said raised part.

8. A vertical blind, comprising:

a. a rotatable driving shaft;

b. a plurality of slat travellers each including a driven shaft and a slip coupling for connecting said driving shaft to said driven shaft; said slip coupling including a bushing mounted on said driving shaft to rotate with said driving shaft and to slide along said driving shaft, and a worm tightly enclosing said bushing and having a screw thread, said bushing having a raised part by which said worm contacts said bushing to tightly enclose said bushing; said driven shaft including a straight toothed worm wheel and first and second stop cams for contacting ends of said screw thread of said worm, each of said stop cams being positioned on the circumference of said worm wheel at a distance from each other and in a space between two adjacent teeth of said worm wheel, wherein said worm can slip with respect to said bushing when said driving shaft rotates and one end of said screw thread contacts said first stop cam or the other end of said screw thread contacts said second stop cam;

c. a plurality of slats, each connected to one driven shaft;

d. means for sliding said slat travellers along said driving shaft; and e. means for rotating said driving shaft.

9. A driving mechanism for a venetian blind, comprising:

a. a movable driving shaft;

b. a movable driven shaft extending at an angle with respect to said driving shaft;

c. a slip coupling for connecting said driving shaft to said driven shaft; said slip coupling including means on one of said shafts having a boss shaped surface, and a first bush shaped gear tightly enclosing said boss shaped surface means and having a screw thread, one of said first gear and said surface means having a raised part by which said first gear contacts said surface means to tightly enclose said surface means; and d. a second gear on the other of said shafts and engaged by said screw thread of said first gear, said second gear having a first stop for stopping movement of said first gear, wherein said first gear may slip with respect to said surface means when said driving shaft moves and an end of said screw thread of said first gear comes in contact with said stop of said second gear.

10. A driving mechanism according to claim 9 wherein said driving shaft is rotatable and said surface means comprises a bushing mounted on and rotatable with said driving shaft, said bushing having said raised part; wherein said first gear is a worm, and said second gear is a straight toothed worm wheel mounted on said driven shaft, said worm wheel having two stop cams for stopping rotation of said first gear when said driving shaft rotates and one end of said screw thread comes in contact with one of said cams or the other end of said screw thread comes in contact with the other of said cams, said cams being spaced apart on the circumference of said worm wheel.

* * * * *